US009111513B1

(12) United States Patent
Piper et al.

(10) Patent No.: US 9,111,513 B1
(45) Date of Patent: Aug. 18, 2015

(54) LUTHIERY FIXTURE

(71) Applicants: Donald Gregory Piper, Mission Viejo, CA (US); John Leslie Partridge, Magalia, CA (US)

(72) Inventors: Donald Gregory Piper, Mission Viejo, CA (US); John Leslie Partridge, Magalia, CA (US)

( * ) Notice: Subject to any disclaimer, the term of this patent is extended or adjusted under 35 U.S.C. 154(b) by 41 days.

(21) Appl. No.: 14/170,590

(22) Filed: Feb. 1, 2014

(51) Int. Cl.
*G10D 3/00* (2006.01)
*G10G 5/00* (2006.01)
*G10D 1/00* (2006.01)

(52) U.S. Cl.
CPC . *G10G 5/00* (2013.01); *G10D 1/005* (2013.01)

(58) Field of Classification Search
CPC ..... G10G 5/00; G10G 1/005
See application file for complete search history.

(56) References Cited

U.S. PATENT DOCUMENTS

| | | | | |
|---|---|---|---|---|
| 1,772,308 | A * | 8/1930 | Ezzelle | 84/280 |
| 3,424,048 | A * | 1/1969 | Mack et al. | 84/290 |
| 5,381,717 | A * | 1/1995 | Brokaw | 84/327 |
| 5,396,824 | A * | 3/1995 | Souza, Jr. | 84/327 |
| 5,537,908 | A * | 7/1996 | Rabe et al. | 84/454 |
| 6,433,265 | B1 * | 8/2002 | McConville | 84/327 |
| 7,605,318 | B2 * | 10/2009 | Dover | 84/327 |
| 7,744,047 | B2 * | 6/2010 | Thorn | 248/176.3 |
| 8,940,985 | B2 * | 1/2015 | Hoffman et al. | 84/293 |
| 2005/0016354 | A1 * | 1/2005 | Kent | 84/327 |
| 2008/0283148 | A1 * | 11/2008 | Hinther | 144/144.52 |
| 2012/0074270 | A1 * | 3/2012 | Pays | 248/121 |

* cited by examiner

*Primary Examiner* — Robert W Horn
(74) *Attorney, Agent, or Firm* — Terry Miller

(57) ABSTRACT

A luthiery fixture or tool provides for a guitar or other stringed instrument to be rotationally supported and securely held above a surface, such as a work bench. The fixture is especially configured to support instruments having differing body dimensions.

16 Claims, 5 Drawing Sheets

LUTHIERY FIXTURE

CROSS REFERENCE TO RELATED APPLICATION

Figure 1:
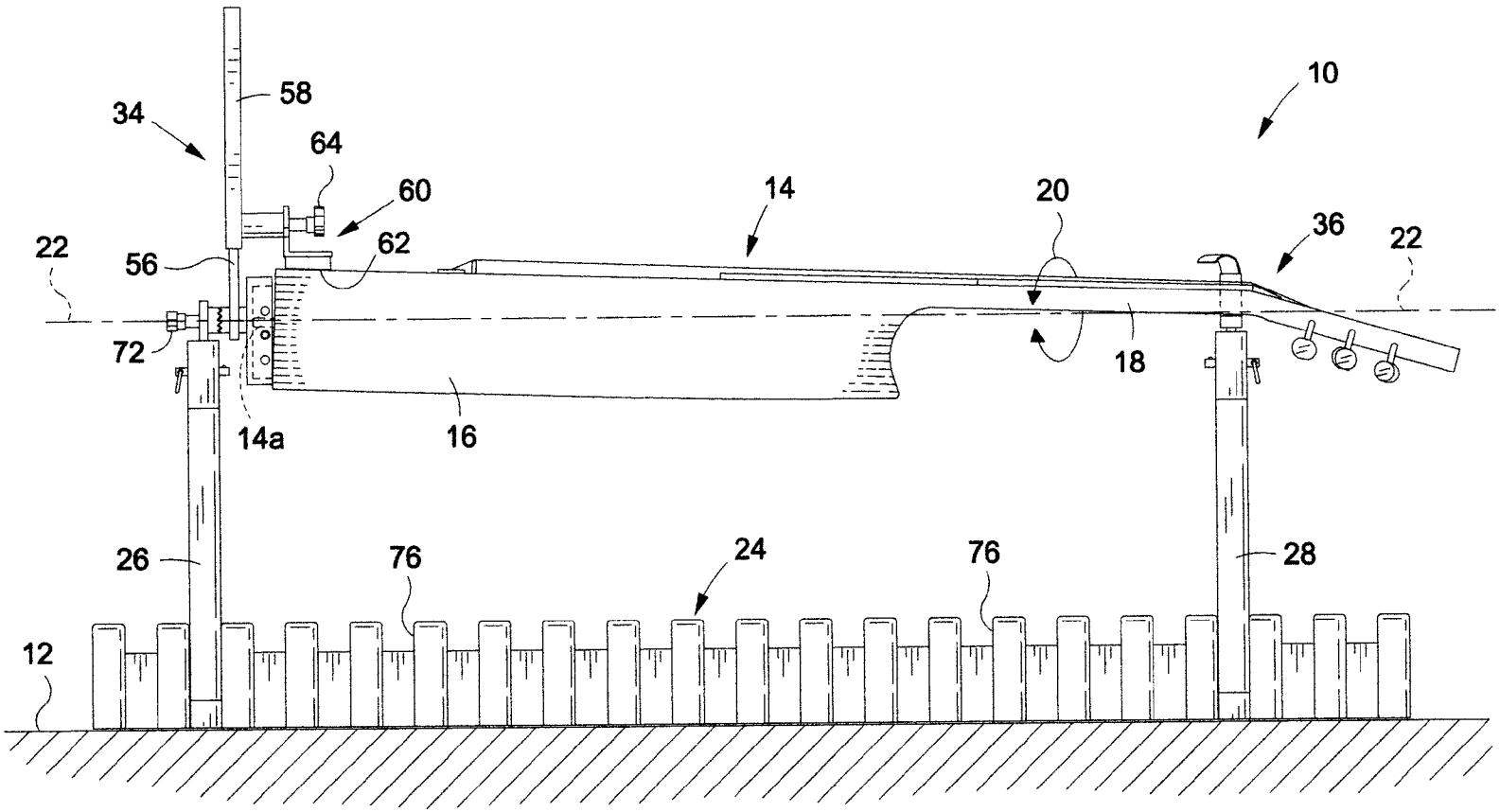

This application is related to and claims the benefit of Provisional Application Ser. No. 61/760,312, filed Feb. 4, 2013.

BACKGROUND OF THE INVENTION

1. Field of the Invention

The present invention relates generally to a luthiery fixture or tool. That is, the present invention relates to a tool or fixture usable in the construction, maintenance, cleaning, or repairing of stringed instruments, such as guitars. More particularly, the tool or fixture according to the present invention has particular use in safely and securely holding an acoustic or electric guitar, which is rotationally suspended and supported above a surface, such as a table top, counter top, or bench top.

2. Related Technology

Conventional expedients available to the consuming public for holding a guitar for construction, maintenance, cleaning or repair amount to little more than a cushion upon which the guitar can be laid or secured for the purpose. Alternatively, the conventional technology provides a cushioned vise for holding the neck of a guitar, supported from a table top, for example, or from a floor via a support such as a tripod.

All of the conventional expedients have one or more disadvantages, in that the guitar is not well supported, or is supported only poorly and via the neck (i.e., as in a vise), or is not rotation, or is possibly subject to damage while it is being worked on or cleaned.

SUMMARY OF THE INVENTION

In view of the deficiencies of the conventional related technology, it is an object of this invention to overcome or reduce one or more of these deficiencies.

Other objects, features, and advantages of the present invention will be apparent to those skilled in the art from a consideration of the following detailed description of a preferred exemplary embodiment thereof taken in conjunction with the associated figures which will first be described briefly.

BRIEF DESCRIPTION OF THE DRAWING FIGURES

Figure 2:
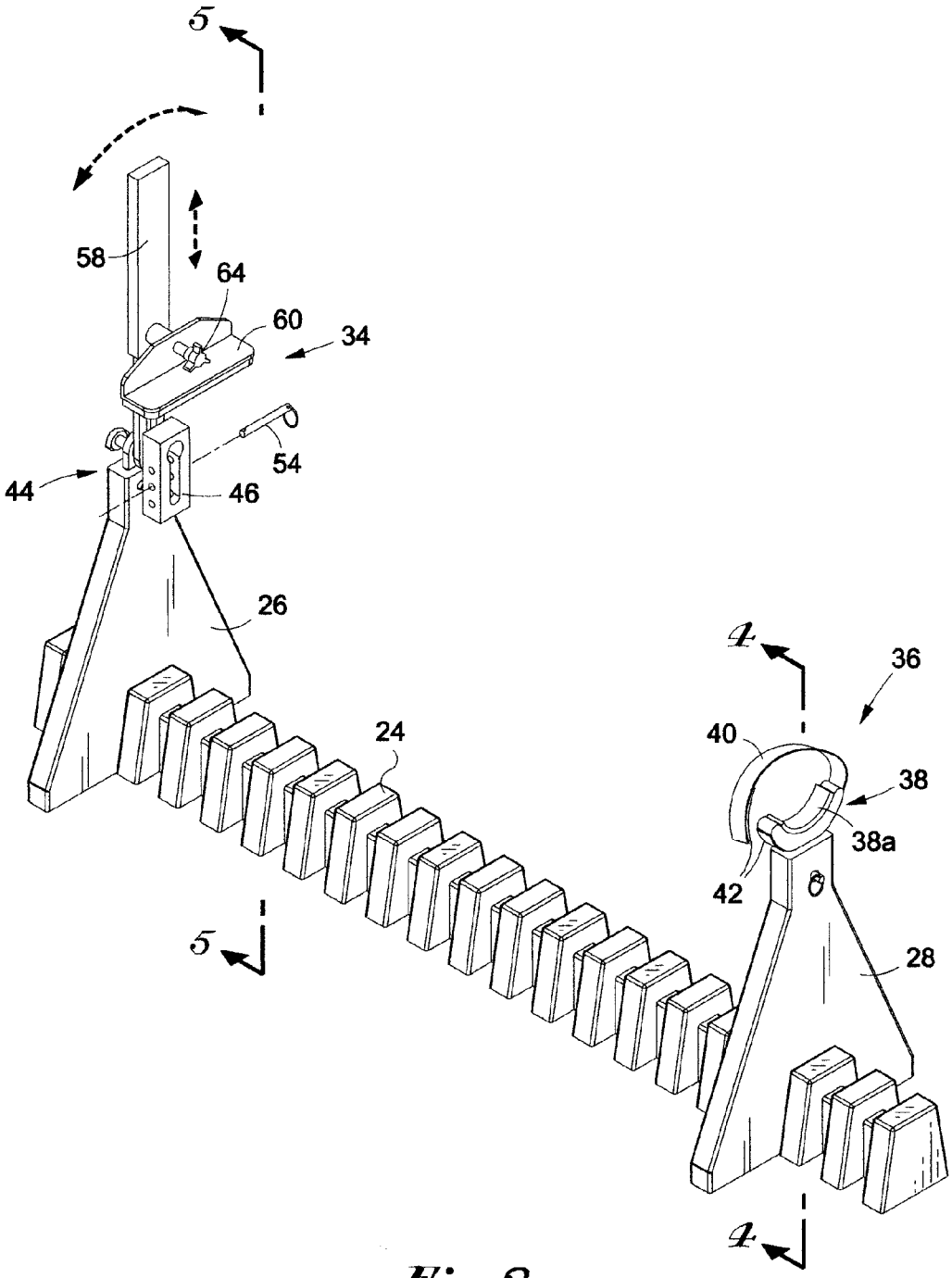
Figure 3:
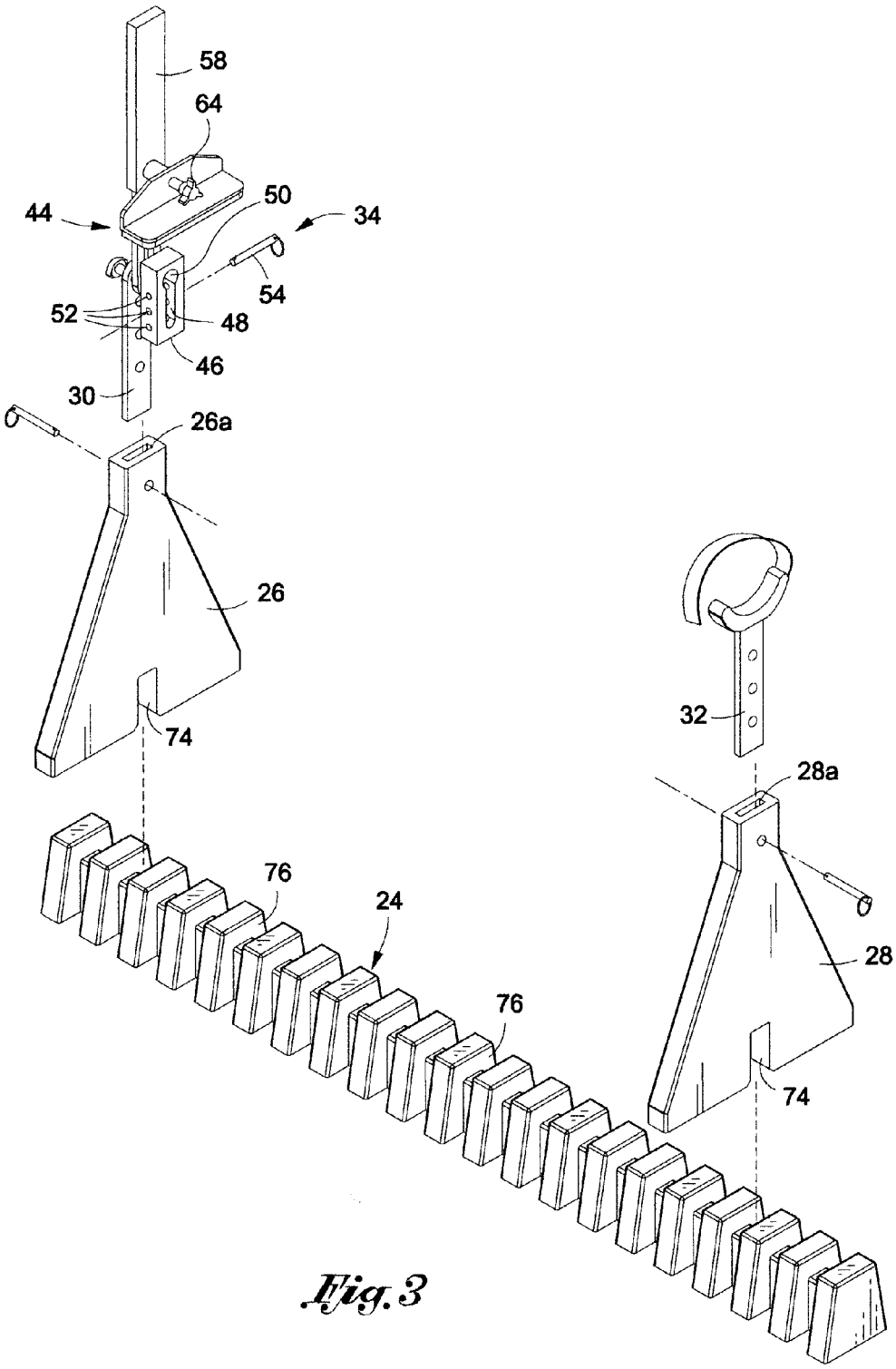
Figure 4:
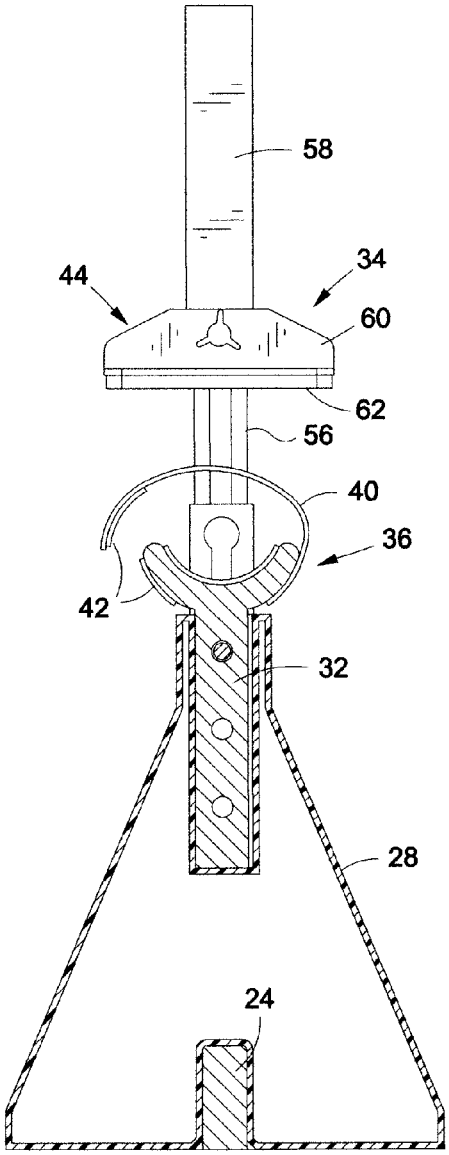
Figure 5:
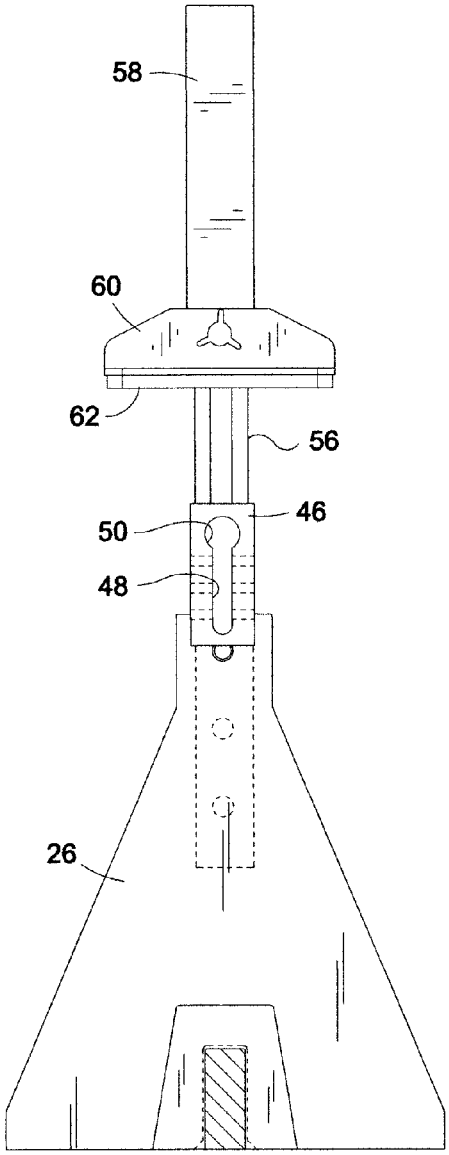
Figure 6:
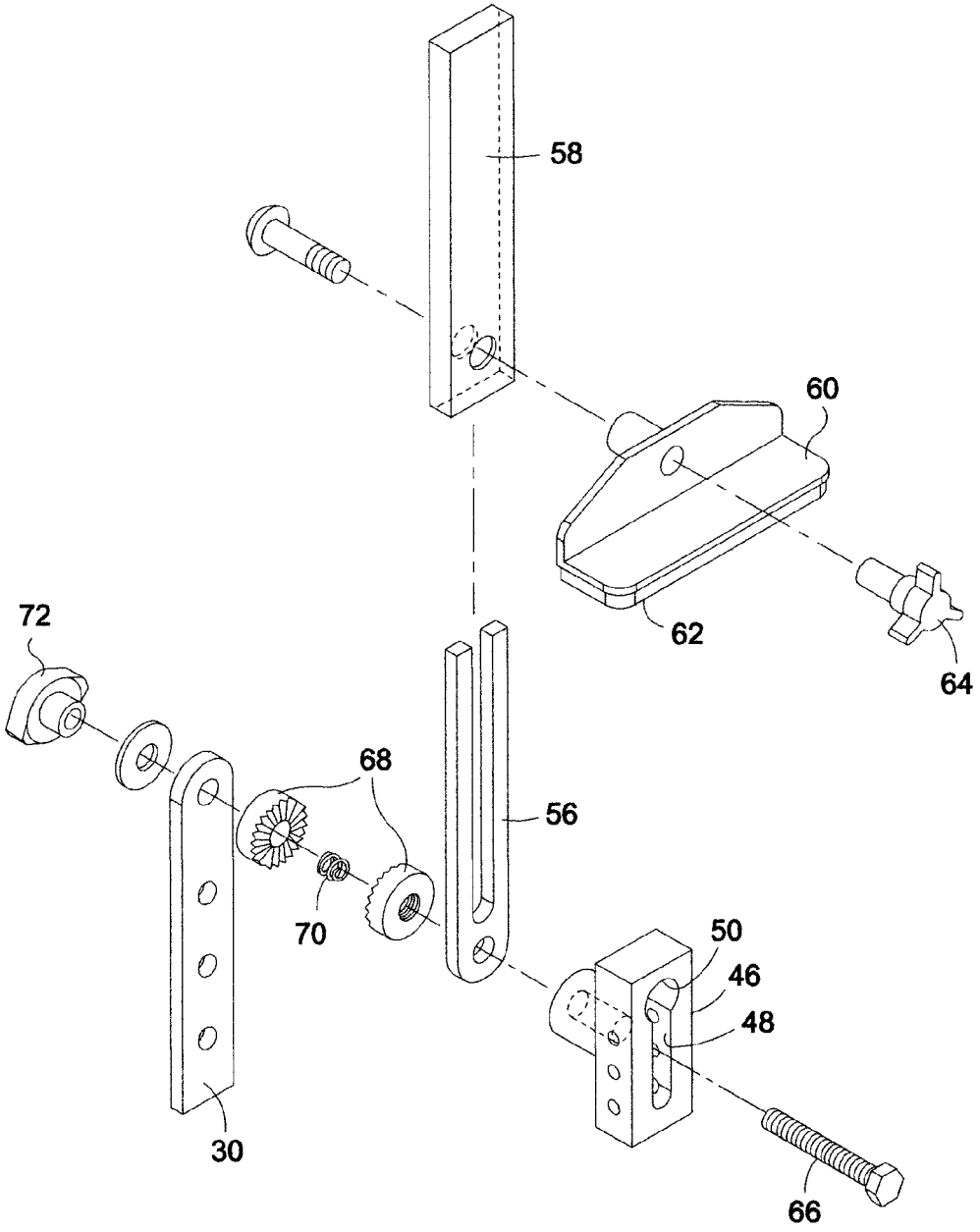

FIG. 1 is a side elevation view of a luthiery tool or fixture embodying the present invention and rotationally supporting a guitar above a surface, such as a table top;

FIG. 2 provides a perspective view of the luthiery fixture or tool seen in FIG. 1;

FIG. 3 is an exploded perspective view of the luthiery fixture or tool seen in FIGS. 1 and 2;

FIG. 4 provides an end elevation view, partially in cross section, of the luthiery fixture or tool seen in FIGS. 1-3, taken generally at the line 4-4 of FIG. 3;

FIG. 5 provides an end elevation view, partially in cross section, of the luthiery fixture or tool seen in FIGS. 1-3, taken generally at the line 5-5 of FIG. 3; and FIG. 6 is an exploded perspective view of a portion of the luthiery fixture or tool seen in the preceding drawing Figures.

DETAILED DESCRIPTION OF AN EXEMPLARY PREFERRED EMBODIMENT OF THE INVENTION

While the present invention may be embodied in many different forms, disclosed herein is one specific exemplary embodiment which illustrates and explains the principles of the invention. It should be emphasized that the present invention is not limited to the specific embodiment illustrated.

Viewing FIGS. 1-6 in conjunction with one another, and with attention first to FIG. 1, it is seen that a luthiery fixture or tool 10 rests upon a surface, such as a table top, counter top, or bench top. Rotationally supported and held securely in the fixture 10 is a guitar 14. In this case, the illustrated guitar is an electrical guitar, although the invention is not so limited. The guitar 14 includes a body 16, and a neck portion 18 extending from the body 16. As will be appreciated, and as further explained below, the guitar 14 is rotationally supported securely above the surface 12, as is generally indicated by the arcuate rotational arrow 20 circumscribing the neck portion 18 of the guitar 14 (still viewing FIG. 1). As is seen on FIG. 1, the guitar is rotationally supported for pivoting movement about a rotational axis indicated at line 22. The line 22 is generally coincident with and extends along the neck 18 of the guitar, and is consequently disposed below but adjacent to the top or stringed face of the guitar 14. Those ordinarily skilled in the pertinent arts will recognize that the guitar 14 is supported as seen in FIG. 1 with its top face, or stringed face, disposed upwardly. However, the guitar 14 is conveniently rotational about the axis 22, and may be rotated to any desired orientation relative to the surface 12 (i.e., about axis 22), there to be retained or locked in the selected rotational position.

Further to the above, it is seen that the fixture 10 includes a beam member 24, to which is attached a pair of adjustably spaced apart upright or support members 26, 28. As is seen in FIGS. 2 and 3, the upright members 26, 28 are generally triangular in end elevation view, and may be identical to one another. Each member 26, 28 at its upper extent defines a vertically extending and upwardly opening socket **26*a*, 28*a*. Slidably disposed securely in close sliding fit, or in light hand-press fit, in each socket 26*a*, 28*a*, is the respective tang portion 30, 32 of a respective one of a pair of rotational support structures, indicated generally with the reference numerals 34 and 36. Considering first the rotational support member 36, it is seen that this structure includes an arcuate, upwardly opening stirrup or clevis portion, generally indicated with arrow 38, and defining an arcuate support surface 38**, upon which is desirably provided a non-marring surface coating (i.e., polyethylene, nylon, or Teflon, for example), or a cushioning material, such as felt (not seen in the drawing Figures).

Still viewing FIGS. 2 and 3 in particular, it is seen that the support structure 36 includes an elongate strap member 40, secured adjacent to one of its ends to one side of the stirrup 38, and arching over the surface **38*a*, to be adjustably attached adjacent its other end portion to the other side of the stirrup 38. To this end, the underside of the stirrup 38 and the engaging end portion of the strap member 40 may be provided with adjustably securing features (indicated with arrowed numeral 42 for inter-engaging with one another in an adjustable but secure arrangement. An example of adjustable securing features which may be employed are snaps and hook-and-loop fasteners. In this way, the neck 18 of the guitar 14 may be received rotationally in the stirrup 38 upon surface 38***a*, and is retained by the strap member 40.

Considering now the rotational support structure 34, it is seen that this structure includes a rotational securing or clamping device, generally referenced with the numeral 44. The clamping device will be seen to be rotationally, and also selectably fixably (that is non-rotationally) supported on tang 30, as will be further explained. In overview, it is seen that the device 44 includes a receiver member 46 defining an elongate key-hole slot 48 for receiving the strap button of guitar 14. In FIG. 1, this strap button is indicated with arrowed numeral 14*a*. The key-hole slot 48 of receiver member 46 includes an enlarged end portion 50 allowing the strap button to be received into the slot 48 and to be there captively held when it is slid along the slot 48 away from the enlarged end portion 50. Because differing guitars, and especially acoustic guitars in comparison to electric guitars, have a body which differs in depth or thickness so that the location of the strap button differs relative to the face or stringed side of the guitar body 16, the receiver member has provision for this fact. That is, in order to allow the strap button of a guitar with a thick body to move more deeply along the receiver member, the slot 48 has a determined length. For guitars with a thinner body to be supported at the desired location relative to the receiver member, the receiver member defines a number of through holes spaced along the length of the member 46. These holes are sized to receive and retain a clevis pin 54 if the type including a spring-loaded detent member.

In order to retain a guitar in the support structure 34 once its strap button is received into slot 48, the support structure includes a stem 56 (best seen in FIGS. 1 and 6) which is rotational along with the clamping device 44 and which carries a slider member 58. The slider member 58 carries a pad member 60 defining an engagement surface 62, which is engageable with the stringed face of the guitar 14. In this case also, the engagement surface is desirably provided with a non-marring surface coating (i.e., polyethylene, nylon, or Teflon, for example), or with a cushioning material, such as felt (not seen in the drawing Figures). Importantly, the slider member 58 is provided with a clamping knob 64 allowing it to be clamped in position along stem 56, so that the pad member prevents the body of the guitar 14 from moving so that the strap button 14*a* is prevented from moving along slot 48 toward the enlarged end portion 50. In this way, the strap button 14*a* is held captive and the body of guitar 14 is retained on the support structure 34.

Further to the above, it will be appreciated that the strap button is thus supported in a location along receiver member 46 such that the rotational axis 22 is disposed just below (or spaced from) the stringed face of the guitar 14. In this way, the rotational axis 22 extends generally parallel with and within the neck 18 of the guitar 14, and within the body 16 of the guitar so that a desired alignment of the guitar 14 with the fixture 10 is achieved.

As is best seen in FIG. 6, the rotational support structure 34 includes a bolt 66 extending through the receiver member 46, and carrying a pair of toothed-face washers 68 each respectively pinned (i.e., non-rotationally), one to the stem 56, and the other to the tang 56. The bolt 66 defines the rotational axis 22 at the support member 34. The toothed washers 68 are spring loaded apart by a spring 70, but may be engaged with one another to inter-engage their respective teeth. When the washers 68 are so engaged, the support structure 34 is non-rotational relative to tang 30. A clamping knob 72 is threadably carried on bolt 66, and when tightened engages the toothed washers 68 with one another. So, it is to be understood that when the clamping knob is loosened by a user of the fixture 10, the rotational support 34 (and guitar 14) may be rotated). On the other hand, the user may retain a selected rotational position of the guitar in the fixture 10 and above the surface 12 by tightening the clamping knob 72.

Finally, viewing FIGS. 3 and 4, it is to be noted that the upright members 26 and 28 are most preferably formed as hollow plastic blow-molded structures, providing great strength and light weight. Each of these upright members 26, 28 defines a slot 74, the walls of which are somewhat resilient because the structure is hollow. On the other hand, the beam member 24 defines plural spaced apart vertically-extending grooves 76 which are sized to be slightly smaller than the thickness of the members 26, 28. Accordingly, a user of the fixture 10 may select the locations for the members 26, 28 along the beam 24 in accord with the body size of the guitar 14, and may force the upright members 26, 28 into appropriate slots of this beam member 24.

Those skilled in the art will further appreciate that the present invention may be embodied in other specific forms without departing from the spirit or central attributes thereof. Because the foregoing description of the present invention discloses only particularly preferred exemplary embodiments of the invention, it is to be understood that other variations are recognized as being within the scope of the present invention. Accordingly, the present invention is not limited to the particular embodiment which has been described in detail herein. Rather, reference should be made to the appended claims to define the scope and content of the present invention.

We claim:

1. A luthiery fixture for resting upon a support surface and rotationally holding a stringed musical instrument having a body and a neck portion extending from the body, said luthiery fixture defining a rotation axis extending along a stringed face of the stringed instrument generally coincident with and extending along the neck of the stringed instrument and adjacent to the stringed face of the stringed instrument, said luthiery fixture further providing for retaining the stringed instrument in selected rotational positions about said rotation axis and above the support surface; said luthiery fixture including a beam member adjustably spacing apart a pair of upright support members; a first of said upright support members upwardly terminating in an arcuate, upwardly opening stirrup portion defining an arcuate support surface upon which a neck portion of the musical instrument may reside in rotational support, a second of said upright support members upwardly terminating in a clamping device for non-rotationally engaging the body of the stringed instrument, said clamping device and said second upright support member cooperatively defining a rotational locking feature allowing the body of the stringed instrument to be rotated relative to said second upright support member and relative to the support surface and to be selectively locked in a desired rotational position.

2. The luthiery fixture of claim 1 further including said clamping device including a support portion defining an opening for supportingly receiving a strap button of said stringed instrument.

3. The luthiery fixture of claim 2 wherein said clamping device further includes a first slider member carrying said support portion so that said support portion is selectively movable toward and from said rotation axis, and means for retaining said support portion in a selected position relative to said rotation axis.

4. The luthiery fixture of claim 3 wherein said clamping device further includes a pad member with an engagement surface engageable with the body of the stringed instrument such as to capture said strap button in said support portion opening, said pad member being selectively slideable relative to said clamping device and rotation axis.

5. The luthiery fixture of claim 4 wherein said clamping device and second upright member cooperatively define a rotation and locking feature on the one hand defining said rotation axis, and on the other hand allowing said clamping device to be released for rotation about said rotation axis, and to be locked in a selected rotational position relative to said rotation axis.

6. The luthiery fixture of claim 5 wherein said clamping device includes an elongate portion, said elongate portion slidably carrying said support portion, and also slidably carrying said pad member, whereby each of said support portion and said pad member may be selectively moved and retainingly positioned relative to said rotation axis in order to adjust said luthiery fixture to the body size and shape of differing stringed instruments.

7. The luthiery fixture of claim 1 in which said pair of upright support members are formed as hollow bodies of shape-retaining but yieldable polymer material.

8. The luthiery fixture of claim 7 in which said beam member provides plural spaced apart vertically extending recesses, and said pair of upright support members are retainingly receivable into engagement with said vertically extending recesses there to be retained by elastic yielding of said polymer material.

9. A luthiery fixture for rotationally holding a guitar or other stringed instrument having a body and a neck portion extending from said body, said luthiery fixture supporting the stringed instrument above a support surface such as a table top or bench top and establishing a rotation axis generally coincident with and parallel with the neck portion of the stringed instrument, said luthiery fixture further allowing said stringed instrument to be selectively rotated about and retained in a selected rotational position about said rotation axis; said luthiery fixture including:

an elongate beam member;

a pair of upright support members adjustably spaced apart along said beam member; a first of said upright support members upwardly terminating in an arcuate, upwardly opening stirrup portion defining an arcuate support surface upon which a neck portion of the musical instrument may reside in rotational support, a second of said upright support members upwardly terminating in a clamping device for non-rotationally engaging the body of the stringed instrument, said clamping device and said second upright support member cooperatively defining a rotational locking feature allowing the body of the stringed instrument to be rotated relative to said second upright support member and relative to the support surface and to be selectively locked in a desired rotational position;

said clamping device including a support portion defining an opening for supportingly receiving a strap button of said stringed instrument, a first slider member carrying said support portion so that said support portion is selectively movable toward and from said rotation axis, and means for retaining said support portion in a selected position relative to said rotation axis, a pad member with an engagement surface engageable with the body of the stringed instrument such as to capture said strap button in said support portion opening, said pad member being selectively slideable relative to said clamping device and rotation axis, a rotation and locking feature on the one hand defining said rotation axis, and on the other hand allowing said clamping device to be released for rotation about said rotation axis, and to be locked in a selected rotational position relative to said rotation axis.

10. The luthiery fixture of claim 9 wherein said clamping device includes an elongate portion, said elongate portion slidably carrying said support portion, and also slidably carrying said pad member, whereby each of said support portion and said pad member may be selectively moved and retainingly positioned relative to said rotation axis in order to adjust said luthiery fixture to the body size and shape of differing stringed instruments.

11. A method of rotationally supporting a stringed instrument having a body and a neck above a surface such as a tabletop or bench top, said method comprising steps of:

providing a pair of adjustably spaced apart upright members;

upwardly terminating one of said pair of adjustably spaced apart upright members in a stirrup member defining an upwardly opening recess for rotationally cradling the neck portion of the stringed instrument;

providing a clamp device disposed adjacent to an upper extent of the other of said pair of adjustably spaced apart upright members, and providing for said clamp device to on the one hand captively engage a strap button on the body of the stringed instrument;

providing for said clamp device to include a locking feature on the one hand allowing rotation of said clamp device about said pivot axis, and on the other hand when said locking feature is locked to prevent rotation of said clamp device about said pivot axis;

whereby the stirrup member and the clamp device cooperatively rotationally support the stringed instrument above said surface for rotational movement and for retaining a selected rotational position.

12. The method of claim 11 further including the step of providing for said clamp device to on the other hand to adjustably define a pivot axis movably positionable relative to the strap button so that the pivot axis is disposed adjacent to an upper stringed surface of the body of the stringed instrument.

13. The method of claim 11 further including the step of providing an elongate beam member inter-engagable with said spaced apart pair of adjustably spaced upright members for spacing said pair of upright members adjustably apart.

14. The method of claim 13 further including the step of providing for said beam member to inter-engage with said pair of adjustably spaced apart upright members in a plurality of relative spaced apart positions.

15. The method of claim 14 further including the step of forming said adjustably spaced apart upright members as hollow bodies of shape-retaining but yieldable polymer material.

16. The method of claim 15 further including the step of forming said beam member with plural spaced apart vertically extending recesses, and said pair of adjustably spaced apart upright members being retainingly receivable into engagement with said vertically extending recesses there to be retained by elastic yielding of said polymer material.

* * * * *